US011414726B2

(12) United States Patent
Gupta et al.

(10) Patent No.: US 11,414,726 B2
(45) Date of Patent: Aug. 16, 2022

(54) INHIBITOR-CONTAINING METAL PARTICLES BY MECHANICAL ALLOYING

(71) Applicants: Rajeev K Gupta, Hudson, OH (US); Mohammad Umar Farooq Khan, Akron, OH (US); Farhan Mirza, Unnao (IN); Javier Esquivel, Cuyahoga Falls, OH (US)

(72) Inventors: Rajeev K Gupta, Hudson, OH (US); Mohammad Umar Farooq Khan, Akron, OH (US); Farhan Mirza, Unnao (IN); Javier Esquivel, Cuyahoga Falls, OH (US)

(73) Assignee: The University of Akron

( * ) Notice: Subject to any disclaimer, the term of this patent is extended or adjusted under 35 U.S.C. 154(b) by 280 days.

(21) Appl. No.: 16/295,494

(22) Filed: Mar. 7, 2019

(65) Prior Publication Data

US 2019/0276914 A1 Sep. 12, 2019

Related U.S. Application Data

(60) Provisional application No. 62/639,610, filed on Mar. 7, 2018.

(51) Int. Cl.
*C22C 1/05* (2006.01)
*B22F 9/04* (2006.01)

(52) U.S. Cl.
CPC ..... *C22C 1/05* (2013.01); *B22F 9/04* (2013.01); *B22F 2009/041* (2013.01); *B22F 2009/043* (2013.01)

(58) Field of Classification Search
CPC ..... C22C 1/05; B22F 9/04; B22F 2009/041; B22F 2009/043; B22F 1/00
See application file for complete search history.

(56) References Cited

U.S. PATENT DOCUMENTS 3,878,993 A * 4/1975 Welsch ..... B02C 19/0056 241/3
4,627,959 A * 12/1986 Gilman ..... B22F 9/04 419/61

(Continued)

FOREIGN PATENT DOCUMENTS

JP 2001011501 A * 1/2001

OTHER PUBLICATIONS

Quatinetz et al. ("The Production of Submicron Metal Powders by Ball Milling with Grinding Aids". NASA. pp. 1-51. Mar. 1962.) (Year: 1962).*

(Continued)

*Primary Examiner* — Anthony J Zimmer
*Assistant Examiner* — Ricardo D Morales
(74) *Attorney, Agent, or Firm* — Renner Kenner Greive Bobak Taylor & Weber

(57) ABSTRACT

A method of making a metallic material includes mechanically alloying base metal with corrosion inhibitor to thereby form an alloy having the base metal and the corrosion inhibitor. A method of preventing corrosion includes providing the alloy to a process environment, allowing the process environment to corrode or crack the alloy to thereby expose the corrosion inhibitor of the alloy to the process environment, allowing a first ionic component of the corrosion inhibitor to be transformed to a second ionic component, and allowing the second ionic component to be repassivated with the alloy to thereby prevent further corrosion or cracking of the alloy.

7 Claims, 2 Drawing Sheets

(56) References Cited

U.S. PATENT DOCUMENTS

| | | | | |
|---|---|---|---|---|
| 5,976,456 | A * | 11/1999 | Ziani | B22F 1/0085 148/513 |
| 2015/0252480 | A1* | 9/2015 | Lapena Rey | C23C 22/361 428/447 |
| 2018/0141120 | A1* | 5/2018 | Storck | B22F 1/0018 |

OTHER PUBLICATIONS

Agarwal ("Nickel and nickel alloys." Handbook of Advanced Materials (2004): 217.) (Year: 2004).*

JP2001011501A english translation (Year: 2001).*

Mahajanam et al. (Application of hydrotalcites as corrosion-inhibiting pigments in organic coatings. Diss. The Ohio State University, 2005.) (Year: 2005).*

Esquivel et al. ("Corrosion Behavior and Hardness of Al-M (M: Mo, Si, Ti, Cr) Alloys." Acta Metallurgica Sinica (English letters) 30.4 (2017): 333-341.) (Year: 2017).*

Mazilkin et al. ("Structural changes in aluminum alloys upon severe plastic deformation." Physics of the Solid State 49.5 (2007): 868-873.) (Year: 2007).*

R.K. Gupta et al.; Aluminum containing Na2CrO4: Inhibitor release on demand; Materials Letters 205 (2017) 194-197; Available online Jun. 17, 2017.

* cited by examiner

INHIBITOR-CONTAINING METAL PARTICLES BY MECHANICAL ALLOYING

CROSS-REFERENCE TO RELATED APPLICATIONS

The present application claims the benefit of U.S. Provisional Patent Application No. 62/639,610, filed Mar. 7, 2018, incorporated herein by reference.

FIELD OF THE INVENTION

Embodiments of the invention are directed to alloys having a corrosion inhibitor. The alloys having a corrosion inhibitor may be made by a method including a step of mechanical alloying, which may be high-energy ball milling.

BACKGROUND OF THE INVENTION

Metallic materials corrode under a variety of conditions, and there are limited methods of preventing this corrosion. A common technique for preventing corrosion is the use of corrosion inhibitors. This can include the addition of a small amount of a corrosion inhibitor into a process stream. However, the addition of inhibitors into the environment is not practical in many situations, for example, in certain marine environments. Corrosion inhibitors have also been utilized in certain coatings. But, these coatings are generally unable to prevent long-term corrosion.

There remains a need in the art for metallic materials having improved corrosion resistance.

SUMMARY OF THE INVENTION

In a first embodiment, an alloy powder includes from 80 to 99.5 weight percent base metal and from 0.5 to 20 weight percent corrosion inhibitor, wherein the base metal is selected from the group consisting of aluminum (Al), zinc (Zn), magnesium (Mg), silicon (Si), chromium (Cr), nickel (Ni), molybdenum (Mo), titanium (Ti), manganese (Mn), vanadium (V), niobium (Nb), germanium (Ge), Tin (Sn), Tantalum (Ta), and combinations thereof, and wherein the corrosion inhibitor is selected from the group consisting of sodium chromate ($Na_2CrO_4$), cerium nitrate ($Ce(NO_3)_3$), sodium vanadate ($Na_2VO_4$), and combinations thereof.

In another embodiment, a method of making a metallic material includes mechanically alloying base metal with corrosion inhibitor to thereby form an alloy having the base metal and the corrosion inhibitor, wherein the base metal is selected from the group consisting of aluminum (Al), zinc (Zn), magnesium (Mg), silicon (Si), chromium (Cr), nickel (Ni), molybdenum (Mo), titanium (Ti), manganese (Mn), vanadium (V), niobium (Nb), germanium (Ge), Tin (Sn), Tantalum (Ta), and combinations thereof, and wherein the corrosion inhibitor is selected from the group consisting of sodium chromate ($Na_2CrO_4$), cerium nitrate ($Ce(NO_3)_3$), sodium vanadate ($Na_2VO_4$), and combinations thereof.

In still another embodiment, a method of preventing corrosion includes providing the alloy of the above embodiments to a process environment, allowing the process environment to corrode or crack the alloy to thereby expose the corrosion inhibitor of the alloy to the process environment, allowing a first ionic component of the corrosion inhibitor to be transformed to a second ionic component, and allowing the second ionic component to be repassivated with the alloy to thereby prevent further corrosion or cracking of the alloy.

BRIEF DESCRIPTION OF THE DRAWINGS

Advantages of the present invention will become better understood with regard to the following description, appended claims, and accompanying drawings wherein:

DETAILED DESCRIPTION OF THE INVENTION

Embodiments of the invention are directed to metals and alloys having a corrosion inhibitor. The metals and alloys having a corrosion inhibitor may be made by a method including a step of mechanically mixing or alloying, which may be high-energy ball milling, one or more base metals with one or more corrosion inhibitors. The inhibitor-containing material, which may also be referred to as an inhibitor-containing alloy, includes the one or more base metals with one or more corrosion inhibitors and has the ability to release the one or more corrosion inhibitors on demand upon corrosion initiation, thereby protecting the affected zones in order to prevent further damage. These metals and alloys may be utilized in a process environment wherein the base metal will begin to corrode or where a coating including the inhibitor-containing material will begin to break. It has been advantageously found that the initiation of corrosion or material degradation will reveal and/or release the corrosion inhibitor to the process environment. This exposes the corrosion inhibitor to the process environment thereby preventing further corrosion of the inhibitor-containing alloy. In one or more embodiments, this may be due to the corrosion inhibitor releasing a particular ionic component that protects the alloy at affected zones. In one or more embodiments, ionic components released upon corrosion initiation may be transformed to different ionic components that then redeposit near affected zones. These redeposited components will then prevent further corrosion following the initial corrosion event. In one or more embodiments, the redeposited components may break to expose further corrosion inhibitor.

Figure 1:
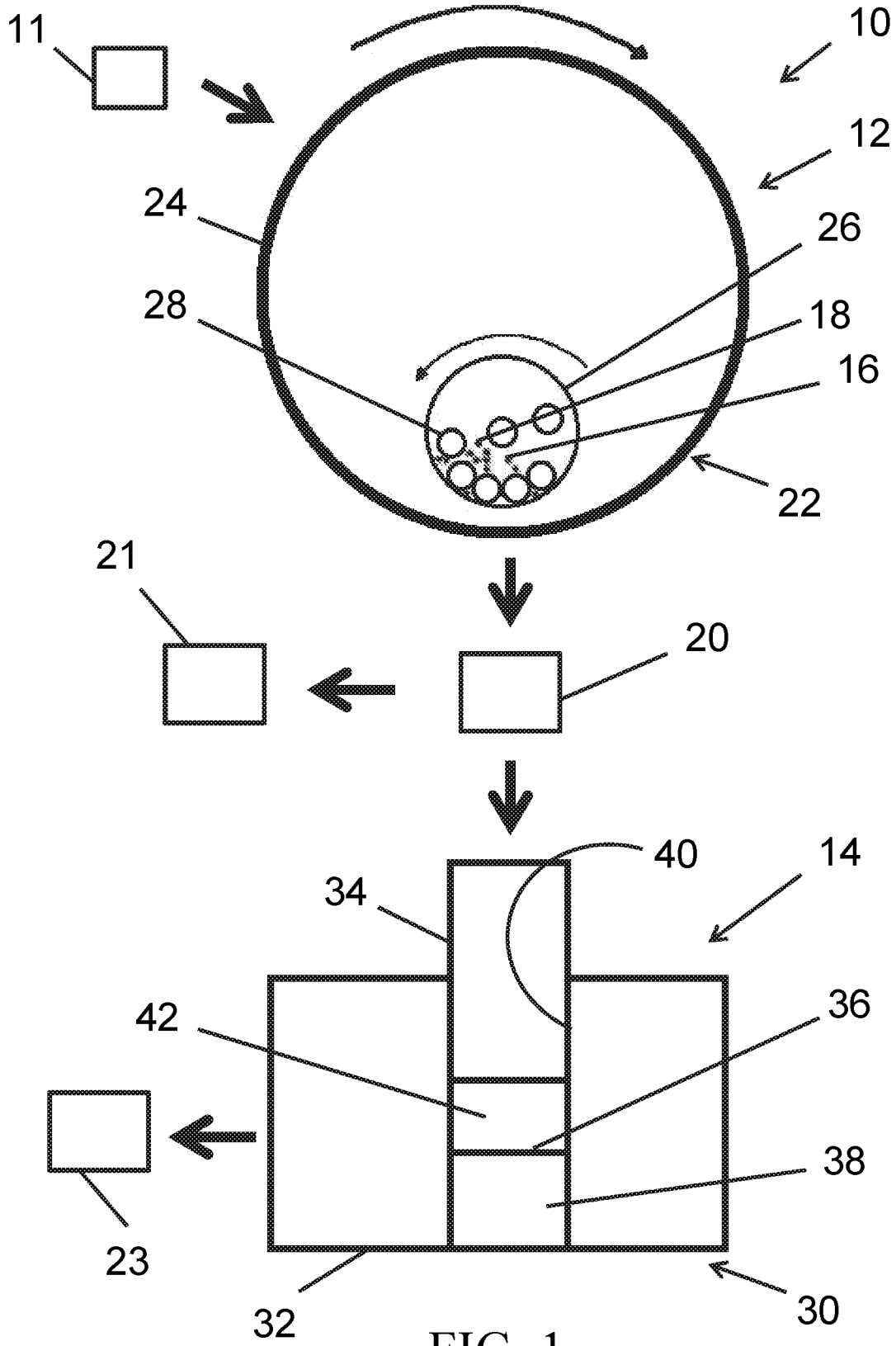
FIG. 1 is a schematic of a method according to one or more embodiments of the present invention.

With reference to FIG. 1, a method 10 of making alloys includes providing a mixture 11 to an alloying step 12, which may be followed by a compacting step 14. Mixture 11 includes one or more base metals 16 and one or more corrosion inhibitors 18. Although FIG. 1 shows mixture 11 being formed outside of the apparatus used for alloying step 12, in one or more embodiments, mixture 11 may be formed within the apparatus used for alloying step 12. Though certain definitions in the art for the term alloy may refer to a combination of two or more elemental metals, it should be appreciated that the term alloy as used herein may be used to define any material including the one or more base metals and the one or more corrosion inhibitors. That is, in embodiments where a single base metal is used with one or more corrosion inhibitors, it may be appropriate to define this inhibitor-containing material as a metal including the one or more corrosion inhibitors, though it should also be appreciated that this material may also be referred to as an alloy to the extent that it includes at least two separate components formed into the inhibitor-containing material.

Alloying step 12 combines base metal 16, which may be in the form of powder, with corrosion inhibitor 18, which may be in the form of powder, to form an alloy. The alloy is collected, as shown in step 20. In one or more embodiments, the alloy from step 20, which may also be referred to as alloy powder 20, may be utilized as an alloy powder product 21 in a variety of applications without being provided to compacting step 14, as further described herein. In one or more embodiments, the alloy from step 20 is provided to compacting step 14. In compacting step 14, the alloy (e.g. alloy powder) is compacted to form one or more alloy compacts 23. Alloy compact 23 is collected and may be utilized in a variety of applications, as further described herein. In one or more embodiments, a portion of the alloy from step 20 is provided as alloy powder product 21 and a portion of the alloy from step 20 is provided to compacting step 14 to form alloy compacts 23.

Base metal 16, which may also be referred to as one or more base metals 16, base metal powder 16, or base metal particles 16, contains one or more metals. These metals generally include those that are susceptible to corrosion upon exposure to mildly aggressive conditions. Exemplary base metals include aluminum (Al), zinc (Zn), magnesium (Mg), silicon (Si), chromium (Cr), nickel (Ni), molybdenum (Mo), titanium (Ti), manganese (Mn), vanadium (V), niobium (Nb), germanium (Ge), tin (Sn), tantalum (Ta), and combinations thereof.

Base metal powder 16, which may also be referred to as an elemental powder, may be characterized by the content of one or more base metals within the powder with respect to other constituents that are not the one or more base metals, also referred to as the purity of the powder. In one or more embodiments, base metal powder 16 has a purity of at least 99 wt. %, in other embodiments, at least 99.5 wt. %, and in other embodiments, at least 99.7 wt. % base metal.

Base metal powder 16 may be characterized by the size of the metal particles within the powder. In one or more embodiments, base metal powder 16 has a size of from −50 mesh to +100 mesh, in other embodiments, from −100 mesh to +500 mesh, and in other embodiments, from −25 mesh to +50 mesh.

Corrosion inhibitor 18, which may be referred to as corrosion inhibitor powder 18 or corrosion inhibitor particles 18, may be made of any suitable one or more corrosion inhibitors that imparts improved corrosion resistance properties to the alloy. Exemplary corrosion inhibitors include sodium chromate ($Na_2CrO_4$), cerium nitrate ($Ce(NO_3)_3$), sodium vanadate ($Na_2VO_4$), and combinations thereof.

Corrosion inhibitor 18 may be characterized by the content of the particular one or more corrosion inhibitors within the powder with respect to other constituents that are not the one or more corrosion inhibitors, also referred to as the purity of the powder. In one or more embodiments, a powder made of corrosion inhibitor 18 has a purity of at least 99 wt. %, in other embodiments, at least 99.5 wt. %, and in other embodiments, at least 99.7 wt. % corrosion inhibitor.

As mentioned above, mixture 11 may be formed outside of the apparatus used for alloying step 12, or mixture 11 may be formed within the apparatus used for alloying step 12. Within alloying step 12, base metal powder 16 and corrosion inhibitor 18 of mixture 11 are merged together. This may include corrosion inhibitor 18 becoming trapped and embedded within base metal 16 in a finely and uniformly dispersed manner, thus creating an inhibitor-containing material. Alloying step 12, which may also be referred to as mechanical alloying step 12, may be any suitable step for alloying base metal 16 with corrosion inhibitor 18 to form the inhibitor-containing material, which may be referred to as an alloy powder, as in step 20. Exemplary alloying steps 12 include high-energy ball milling (HEBM), cryomilling, gas-dynamic cold-spray, and additive manufacturing. Alloying step 12 may be dry or wet.

Where alloying step 12 includes high-energy ball milling, this step generally serves to merge together base metal powder 16 and corrosion inhibitor 18 into an alloy powder 20. High-energy ball milling alloying step 12 may induce grain refinement and high solute concentration of corrosion inhibitor 18 in the alloy powder 20. The alloy powder 20 may include uniform dispersion, also referred to as secondary phases, of corrosion inhibitor 18 within base metal 16.

With reference to FIG. 1, an exemplary high-energy ball milling step 12 utilizes a high-energy ball mill 22, which may be referred to as planetary mill 22, including a rotatable base 24, which may be cylindrical, carrying one or more rotatable sample pots 26. One or more rotatable sample pots 26, which may be referred to as mill rotation pots 26, are hollow cylindrical shells and receive base metal 16 and corrosion inhibitor 18, as well as a plurality of grinding balls 28. Where high-energy ball mill 22 includes a single sample pot 26, one or more counterweights (not shown) may be utilized for balancing purposes. Where high-energy ball mill 22 includes a plurality of sample pots 26, the plurality of sample pots 26 may be utilized with each other for balancing purposes. One or more counterweights may also be used in embodiments where high-energy ball mill 22 includes a plurality of sample pots 26. The one or more counterweights may be adjustable on an inclined guide rail (not shown). In embodiments where high-energy ball mill 22 includes a plurality of sample pots 26, the sizes of the plurality of sample pots 26 may be the same or different.

Where a plurality of rotatable sample pots 26 are utilized, any suitable number may be used. In one or more embodiments, two rotatable sample pots 26 are utilized, in other embodiments, three rotatable sample pots 26 are utilized, and in other embodiments, four rotatable sample pots 26 are utilized.

One or more rotatable sample pots 26 each have an axis positioned eccentrically from the axis of rotatable base 24. In operation, one or more rotatable sample pots 26 rotate about their axis in a first direction. The axis of one or more rotatable sample pots 26 may be either horizontal or at a small angle to the horizontal. Rotatable base 24 rotates about its axis in a direction opposite the rotation of one or more rotatable sample pots 26.

Rotatable base 24 and one or more rotatable sample pots 26 rotate at different rotational speeds. Grinding balls 28 are therefore forced from one location along the circumference of sample pot 26 to a different location away from the original location. The difference in speeds between grinding balls 28 and one or more rotatable sample pots 26 produces high degree of collision energy, which is thereby transmitted to the base metal powder 16 and corrosion inhibitor powder 18. Based on the rotation, grinding balls 28 are subjected to superimposed rotational movements, generally known as Coriolis forces. The interplay between the frictional and impact forces applied on the combination of base metal powder 16 and corrosion inhibitor powder 18 produces the high and effective degree of alloying.

The rotation speed of the rotatable base 24 may be different or identical to that of the rotatable sample pots 26. An exemplary suitable ratio of the rotation speed of rotatable base 24 and rotatable sample pot 26 to achieve desired alloying of the powder may be 1:1. In other embodiments, this ratio could be 1:2 or 1:5. In other embodiments, this ratio could be in a range of from 1:1 to 1:5, in other embodiments, from 1:2 to 1:5.

Rotatable base 24 may rotate at any suitable rotational speed. In operation, an exemplary of the rotational speed of the rotatable base 24 may be 280 RPM or approximate thereto. In other embodiments, the rotation speed of the rotatable base 24 may range from 150 RPM to 1600 RPM, in other embodiments, from 250 RPM to 400 RPM.

One or more rotatable sample pots 26 may rotate at any suitable rotational speed. In operation, an exemplary of the rotational speed of the rotatable sample pots 26 may be 280 RPM. In other embodiments, the rotation speed of the rotatable sample pots 26 may range from 150 RPM to 1600 RPM, in other embodiments, from 250 RPM to 400 RPM.

One or more rotatable sample pots 26 may be made of any suitable material, such as hardened steel, stainless steel, and tungsten carbide. In one or more embodiments, the inner surface of one or more rotatable sample pots 26 may be lined with an abrasion-resistant material, such as manganese steel or rubber.

One or more rotatable sample pots 26 may have any suitable overall volume. An exemplary of one rotatable sample pot may have a capacity of 250 mL or approximate thereto. In other embodiments, the rotatable sample pots may have a capacity that ranges from 25 mL to 5000 mL, in other embodiments, from 100 mL to 500 mL, and in other embodiments, from 200 mL to 400 mL.

One or more rotatable sample pots 26 may have any suitable fill volume, characterized as a percentage of the overall volume. This fill volume may range from 15% to 95% of the total volume. In one or more embodiments, this fill volume may be at least 25%, in other embodiments, at least 50%, and in other embodiments, at least 75% of the total volume.

Grinding balls 28 may be made of any suitable material, such as steel, stainless steel, tungsten carbide, other metals, ceramics, and rubber. Grinding balls 28 may be of any suitable size, and should be substantially larger than base metal particles 16 and corrosion inhibitor particles 18. Grinding balls 28 may be of any suitable density, and are generally denser than the largest base metal powder particles 16 and corrosion inhibitor particles 18. Grinding balls 28 may be of any suitable hardness sufficient to grind, deform, fracture, and alloy base metal powder particles 16 and corrosion inhibitor 18.

Grinding balls 28 may be provided at a particular weight ratio with respect to base metal powder particles 16 and corrosion inhibitor 18. In one or more embodiments, the weight ratio of grinding balls 28 to the combination of both base metal particles 16 and corrosion inhibitor particles 18 is at least 5:1, in other embodiments, at least 16:1, and in other embodiments, at least 50:1. In these or other embodiments, the weight ratio of grinding balls 28 to the combination of both base metal particles 16 and corrosion inhibitor particles 18 is less than 60:1, in other embodiments, less than 40:1, and in other embodiments, less than 20:1. In one or more embodiments, the weight ratio of grinding balls 28 to the combination of both base metal particles 16 and corrosion inhibitor particles 18 is 5:1 or approximate thereto, in other embodiments, 16:1 or approximate thereto, and in other embodiments, 50:1 or approximate thereto.

In one or more embodiments, an additive may be utilized in the one or more rotatable sample pots 26 with base metal powder 16, corrosion inhibitor powder 18, and grinding balls 28. The additive may be a lubricant, which may be referred to as a process control agent (PCA). An exemplary process control agent is stearic acid. The additive may be utilized in amounts from 0 wt. % to 2 wt. %, in other embodiments, from 0.5 wt. % to 1.5 wt. %, in other embodiments from 0.5 wt. % to 1 wt. %, and in other embodiments, about 1.5 wt. %.

In these or other embodiments, an inert shield gas that does not react with the material being ground may be utilized as an additive. The inert shield gas may be utilized to prevent oxidation.

Alloying step 12 may be performed for any suitable length of time to achieve sufficient alloying of base metal powder 16 and corrosion inhibitor powder 18. An exemplary of the length of time required for alloying step 12 is 100 hours or approximate thereto. In one or more embodiments, alloying step 12 is performed for a range of time from 5 hours to 200 hours, and in other embodiments, from 20 hours to 150 hours. In one or more embodiments, alloying step 12 is performed for at least 10 hours, in other embodiments, at least 20 hours, and in other embodiments, at least 50 hours.

The length of time for alloying step 12 may also be characterized by alloying step 12 proceeding until the alloy has a particular microstructure. In one or more embodiments, alloying step 12 is performed until the alloy has a mean grain size of less than 100 nm. In these or other embodiments, the solute concentration of corrosion inhibitor 18 in the alloy powder 20 is larger than 50%. In one or more embodiments, the grain size is less than 300 nm. In these or other embodiments, a supersaturation of higher than 30% of corrosion inhibitor 18 in the alloy powder 20 is achieved.

In one or more embodiments, the above times for performing alloying step 12 may include intermittent interruption or pause times in order to allow the alloying materials to cool. In one or more embodiments, alloying step 12 includes interruptions from 15 min to 60 min every 1 hour of alloying, and in other embodiments, from 1 hour to 2 hours every 2 hours of alloying.

In these or other embodiments, alloying step utilizes a cooling medium, such as water and liquid nitrogen, for preventing overheating of the alloying materials. In certain embodiments, the use of a cooling medium may allow alloying step 12 to be devoid of interruption times to cool the alloying materials.

Alloying step 12 may be performed at any suitable temperature. In one or more embodiments, alloying step 12 is performed at ambient temperature, which may be from 20° C. to 25° C., and in other embodiments, 23° C. or approximate thereto. In one or more embodiments, alloying step 12 occurs at the temperature of liquid nitrogen (−195.8° C.) or approximate thereto, and in other embodiments, from −150° C. to 100° C.

Alloying step 12 may be characterized by the ratio between the amount of corrosion inhibitor powder 18 incorporated in the alloy solid solution after alloying step 12 with the initial amount of corrosion inhibitor powder 18 added as raw material. In one or more embodiments, this ratio is at least 10%, in other embodiments, at least 30%, in other embodiments, at least 50%, in other embodiments, at least 70%, in other embodiments, at least 90%, and in other embodiments, at least 95%. In one or more embodiments this ratio is in a range from 10% to 100%, and in other embodiments from 30% to 90%. In one or more embodiments, this ratio could reach 100% or approximate thereto.

In one or more embodiments, method 10 includes compacting step 14 to form an alloy compact 23. Compacting step 14 may be any suitable step for compacting the alloy from step 20 (e.g. alloy powder) to form an alloy compact 23. Exemplary compacting steps 14 include cold compaction, equal-channel angular pressing or extrusion, and spark-plasma sintering. Compacting step 14 generally serves to apply sufficient pressure to physically bond particles from the alloy in step 20 to form alloy compact 23.

With reference to FIG. 1, an exemplary compaction step 14 utilizes a compaction assembly 30 having a die 32 and a compaction plunger 34. Alloy powder 20 is collected from alloying step 12 and provided to compacting step 14. Alloy powder 20 may be particularly provided to a receptacle 36 formed within die 32 and defined by a lower plunger 38 and an inner channel 40 within die 32. Alloy powder 20 in receptacle 36 is then pressurized by uniaxial travel of compaction plunger 34 toward lower plunger 38. During the compaction, as shown in FIG. 1, the in-progress compaction item may be referred to as a green compact 42. Upon completion of the compaction, the completed alloy compact 23 is collected. This may include lower plunger 38 moving alloy compact 23 out of inner channel 40. Though FIG. 1 shows compaction assembly 30 including only one pair of compaction plunger 34 and lower plunger 38, any suitable number of pairs may be used.

Cold compaction generally refers to a compaction step 14 where the compaction occurs without an applied heat source, and therefore may also be referred to as ambient temperature compaction. In one or more embodiments, cold compaction occurs at a temperature from 5° C. to 45° C., in other embodiments, from 20° C. to 25° C., and in other embodiments, 23° C. or approximate thereto.

The compaction pressure may be any suitable pressure. In one or more embodiments, compaction occurs at a maximum pressure of from 100 MPa to 5 GPa, in other embodiments, from 500 MPa to 4 GPa, and in other embodiments, from 1 GPa to 3 GPa. In one or more embodiments, compaction occurs at a maximum pressure of at least 1 GPa, in other embodiments, at least 2 GPa, in other embodiments, at least 3 GPa, and in other embodiments, at least 4 GPa. Uniaxial pressure during compaction may be held for a time range of from 1 minute to 1 hour, and in other embodiments, from 5 minutes to 30 minutes. Uniaxial pressure during compaction may be held for at least 5 minutes, in other embodiments, at least 10 minutes, and in other embodiment, at least 20 minutes.

The compaction may include incremental pressuring steps on the way to achieving the maximum pressure. In one or more embodiments, compaction steps occur at increments of from 10 MPa to 1 GPa, in other embodiments, from 100 MPa to 500 MPa, and in other embodiments, from 150 MPa to 200 MPa. In one or more embodiments, compaction steps occur at increments of 187 MPa or approximate thereto. In one or more embodiments, the maximum pressure may be applied directly in a single step. In one or more embodiments, the number of incremental steps may range from 1 to 16, and in other embodiments, from 1 to 200. In one or more embodiments, the number of incremental steps may be at least 10, in other embodiments, at least 15, and in other embodiments, at least 20.

The materials used to make compaction assembly 30 used for compaction step 14 may be made of any suitable materials, such as hardened steel, stainless steel, tungsten carbide, other metals, and ceramic materials.

In one or more embodiments, a method of making an alloy compact may include one or more secondary processing steps, such as coining or heat treatment, following compaction step 14, in order to achieve further desired properties or enhanced precision. In one or more embodiments, a method of making an alloy compact may be devoid of a secondary processing step following compaction step 14.

The alloy powder (e.g. alloy powder 21) and alloy compact (e.g. alloy compact 23) formed by method 10 are alloys that contain base metal and corrosion inhibitor. Both alloy powder and alloy compacts may therefore be collectively referred to as inhibitor-containing alloys.

Figure 2:
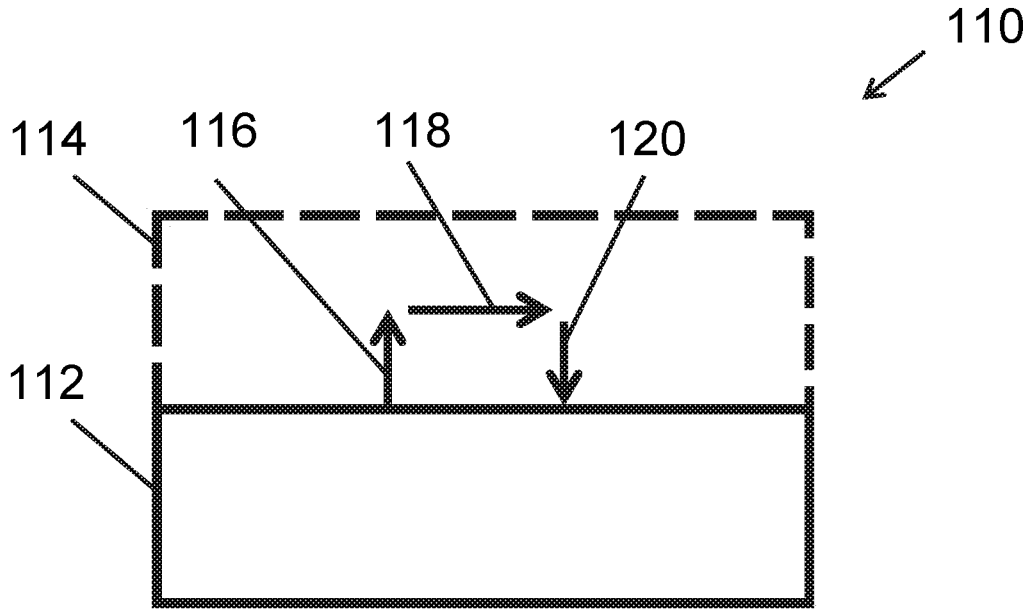
FIG. 2 is a schematic of a method according to one or more embodiments of the present invention.

With reference to FIG. 2, a method 110 of using an inhibitor-containing alloy 112 (e.g. the alloy powder 21 and/or the alloy compact 23 including base metal 16 and corrosion inhibitor 18) includes providing inhibitor-containing alloy 112 to a process environment 114, which may also be referred to as a corrosion-imparting environment 114. Inhibitor-containing alloy 112 may be provided as the sole composition of a component or may be provided as a coating on a separate component. In the case of the inhibitor containing metal as the sole composition of the component, the inhibitor-containing alloy 112 and process environment 114 may be designed such that base metal 16 of inhibitor-containing alloy 112 will begin to corrode and thereby release corrosion inhibitor 18. In another case, where inhibitor-containing alloy 112 is provided as a coating on a separate component (i.e. made of a different material than inhibitor-containing alloy 112), the coating will begin to crack or corrode in presence of process environment 114 and corrosion inhibitor 18 will be released. In both cases of the inhibitor-containing alloy 112 being used as a sole component or as a coating on another component, this initiation of corrosion will reveal and/or release corrosion inhibitor 18 to process environment 114 in a release step 116.

In one or more embodiments, release step 116 includes corrosion inhibitor 18 releasing a particular ionic component (e.g. $Cr^{6+}$) to process environment 114. Within a transformation step 118, the first particular ionic component may be transformed to a different ionic component (e.g. $Cr^{3+}$). Within a subsequent redepositing step 120, the transformed ionic component may then be redeposited, or repassivated, with the inhibitor-containing alloy 112. This redeposited transformed ionic component can then prevent further corrosion of the inhibitor-containing alloy 112. A small difference between the pitting potential and repassivation potential of inhibitor-containing alloy 112 may be an indication that suitable repassivation of the transformed ionic component has occurred. Based on this method 110 of repassivation, inhibitor-containing alloy 112 may be described as a self-healing metallic material.

It should be appreciated that release of the corrosion inhibitor (e.g. corrosion inhibitor 18) may rely on the corrosion of the base metal (e.g. base metal 16) of inhibitor-containing alloy 112 in which they are embedded. The one or more base metals may therefore be selected based on which one or more base metals will trigger the release of the corrosion inhibitor in a desired process environment 114.

For example, release of the corrosion inhibitor may depend on the pH of process environment 114 because different base metals corrode at different pH levels. As further example, aluminum corrodes in relatively high and low pH conditions. Thus, aluminum would generally be a desired candidate for the base metal to encapsulate the corrosion inhibitor if the release of the corrosion inhibitor in high or low pH (e.g. pH greater than 8 and less than 6) conditions was desired. In the same light, aluminum would generally not be a desired candidate for the base metal in generally neutral pH conditions. As further examples, magnesium is generally a desired candidate for the base metal for the release of the corrosion inhibitor in pH of less than 10, and zinc is generally a desired candidate for the base metal for the release of the corrosion inhibitor at relatively lower pH conditions (i.e. more acidic), but not for relatively higher pH conditions (i.e. more basic).

As another example, the release of the corrosion inhibitor may depend on the salt concentration of the process environment 114 because different base metals corrode at different salt concentrations.

The selection of particular one or more base metals and one or more corrosion inhibitors based on the process conditions may include the use of graphed properties. For example, pH versus potential graphs can be developed. These graphs generally indicate the areas of corrosion and passivation for the various ionic components at differing pH and potential. These and other graphs can therefore be used for suitable designs.

Other electrochemical characteristics of a substrate including inhibitor-containing alloy 112 and other service conditions of process environment 114 may be utilized to select particular base metal and corrosion inhibitor for inhibitor-containing alloy 112.

Inhibitor-containing alloys (e.g. inhibitor-containing alloy 112) may be characterized by the amounts of the base metal and the corrosion inhibitor within the inhibitor-containing alloy. In one or more embodiments, an inhibitor-containing alloy includes from 50 to 99.5 weight percent, in other embodiments, from 75 to 95 weight percent, in other embodiments, from 80 to 90 weight percent, and in other embodiments from 80 to 99.5 weight percent of the base metal. In these or other embodiments, an inhibitor-containing alloy includes at least 50 weight percent, in other embodiments, at least 80 weight percent, in other embodiments, at least 85 weight percent, and in other embodiments at least 95 weight percent of base metal.

As indicated above, base metal 16 may include a combination of metals. In one or more embodiments, this combination of metals includes a first primary metal present in a majority amount and a secondary metal present in a minority amount. In one or more embodiments, the base metal includes from 80 to 99.5 atomic percent, in other embodiments, from 90 to 99 atomic percent, in other embodiments, from 98.5 to 99.5 atomic percent, in other embodiments, from 95 to 98.5 atomic percent, and in other embodiments from 90 to 95 atomic percent of a primary metal. In one or more embodiments, the base metal includes from 0.5 to 10 atomic percent, in other embodiments, from 0.5 to 1.5 atomic percent, in other embodiments, from 0.5 to 1 atomic percent, in other embodiments, from 1 to 5 atomic percent, and in other embodiments from 5 to 10 atomic percent of a secondary metal.

In one or more embodiments, an inhibitor-containing alloy includes from 0.5 to 50 weight percent, in other embodiments, from 5 to 25 weight percent, in other embodiments, from 10 to 20 weight percent, in other embodiments, from 0.5 to 1 weight percent, in other embodiments, from 0.5 to 20 weight percent, and in other embodiments, from 1 to 5 weight percent of the corrosion inhibitor. In these or other embodiments, an inhibitor-containing alloy includes at least 1 weight percent, in other embodiments, at least 5 weight percent, in other embodiments, at least 10 weight percent, and in other embodiments at least 15 weight percent of the corrosion inhibitor. It should be appreciated that the weighted, and atomic, amounts of base metal and corrosion inhibitors utilized in the alloying step described herein may also be characterized by these weight percentages within the inhibitor-containing alloy.

As mentioned above, inhibitor-containing alloys include the corrosion inhibitor becoming trapped and embedded within base metal in a finely and uniformly dispersed manner. This uniform dispersion may be characterized by the compositional properties being similar or identical when analyzed at different portions of the inhibitor-containing alloy.

The alloy compacts may be any suitable shape. An exemplary shape includes cylindrical pellets.

In one or more embodiments, alloy powder 20 may be compacted by gas-dynamic cold spray to form a thick layer or lump which can be subsequently machined into complex geometries. In other embodiments, alloy powder 20 may be compacted by additive manufacturing into any geometry according to specifications of the machine.

The alloy compacts may be characterized by size. In one or more embodiments, the alloy compacts have a diameter from 0.5 mm to 10 cm, in other embodiments, from 2 mm to 8 mm, and in other embodiments, from 3 mm to 7 mm. In one or more embodiments, the alloy compacts have a thickness of from 0.5 mm to 10 cm, in other embodiments, from 1 mm to 9 mm, and in other embodiments, from 2 mm to 5 mm.

The alloy compacts may be characterized by hardness or strength. Hardness may be determined by the Vickers hardness test. In one or more embodiments, the alloy compacts have a Vickers hardness that ranges from 50 to 200 HV, in other embodiments, from 30 to 100 HV, and in other embodiments, from 100 to 200 HV. In these or other embodiments, the alloy compacts have a Vickers hardness of at least 30 HV, in other embodiments, at least 50 HV, in other embodiments, at least 100 HV, and in other embodiments, at least 150 HV.

The Inhibitor-containing alloys may be characterized by corrosion resistance. Corrosion resistance may be characterized by the pitting potential ($E_{pit}$) and the transition potential ($E_{trans}$). $E_{pit}$ and $E_{trans}$ can be determined from the cyclic potentiodynamic polarization (CPP) test.

The advantageous corrosion resistance of the alloy compacts may be attributed to the concurrent influence of the grain boundary and uniform and refined microstructure. The alloy compacts may be characterized by grain size. The alloying step and the compacting step, as well as the particular metal utilized, generally impact the grain refinement of the alloy compacts. In one or more embodiments, alloy compacts have a grain size of less than 100 nm, in other embodiments, less than 150 nm, and in other embodiments, less than 300 nm.

The alloy compacts may be characterized by porosity. In one or more embodiments, alloy compacts have a porosity of from 0 to 15%, and in other embodiments, from 5 to 10%. In one or more embodiments, alloy compacts have a porosity of at least 5%, and in other embodiments, at least 10%.

As described above, the inhibitor-containing alloys (i.e. alloy powder and alloy compacts) may be utilized in a variety of suitable applications. The inhibitor-containing alloys may be utilized in the coating, additive manufacturing, automotive, marine, aerospace, and architecture industries.

Where the alloy powder is utilized, the alloy powder may be consolidated to produce bulk materials for structural applications. The alloy powders may also be used for one or more of the following: powder for supersonic particle deposition/cold spray for coating or repairing the engineering structures, powder for additive manufacturing, powder to produce bulk components using a powder metallurgical route, and powder for addition into primers and coatings.

Another application of the alloy powders may be additives to conventional organic coatings for improved corrosion performance.

Where the alloy compacts are utilized, the alloy compacts are capable of replacing conventional alloys leading to significant improvement in the performance and life of the engineering components.

In light of the foregoing, it should be appreciated that the present invention advances the art by providing improved alloys and corresponding methods of manufacture. While particular embodiments of the invention have been disclosed in detail herein, it should be appreciated that the invention is not limited thereto or thereby in as much as variations on the invention herein will be readily appreciated by those of ordinary skill in the art. The scope of the invention shall be appreciated from the claims that follow.

EXAMPLES

Base metal powder (purity 99.7%, size −50/+100 mesh) with varying amounts of $Na_2CrO_4$ (0.5, 1, 5, and 20 wt. %) was alloyed by HEBM in a planetary ball mill for 60 hours at a speed of 280 RPM. Al powder and $Na_2CrO_4$ were loaded in hardened steel jars with hardened steel balls (10 mm diameter). Stearic acid (1.5 wt. %) was used as process controlling agent. The steel jars were loaded and sealed in a glove box to maintain an inert atmosphere (high purity Ar atmosphere, $O_2$<25 ppm) during milling. HEBM was interrupted automatically for 30 min (to allow cooling and avoid overheating) after every 1 h of milling.

The powder after HEBM was consolidated in a tungsten carbide die under a uniaxial pressure of 3 GPa. The cold compacted test specimens were of 7 mm diameter and 1.5 mm thickness.

The microstructural characterization was carried out using secondary electron and back scatter electron imaging with Tescan Lyra 3 SEM equipped with energy dispersive X-ray spectroscopy (EDXS). The SEM samples were polished down to 1 μm diamond finish. Ethanol was used for grinding and polishing to avoid dissolution of the $Na_2CrO_4$.

Cyclic potentiodynamic polarization (CPP) tests were performed using a VMP-300 potentiostat. All samples were ground up to 1200 grit SiC sandpaper followed by rinsing with ethanol and drying. Corrosion tests were carried out in a conventional three-electrode electrochemical cell, using a platinum mesh as counter electrode and a saturated calomel electrode (SCE) as reference electrode. All tests were performed in 0.01 M NaCl. The open circuit potential (OCP) of the samples was monitored for 30 min before commencing the potentiodynamic polarization tests. Potential scans started from 250 mV below OCP with a scan rate of 1 mV/s and were reversed to cathodic direction when an anodic current of 250 $\mu A/cm^2$ was reached.

Immersion tests were performed in 0.1 M NaCl. Following the immersion tests, specimens were visually inspected and then chemically cleaned in concentrated $HNO_3$ to remove corrosion products, with negligible attack of the substrate occurring from such cleaning. The SEM analysis was conducted to evaluate localized corrosion. The choice of the electrolytes for CPP and immersion tests was based on the literature for studying the corrosion behavior of Al alloys.

X-ray photoelectron spectroscopy (XPS) analysis was carried out to evaluate the chemical composition of the corrosion films developed on $Na_2CrO_4$ containing Al. Consolidated samples were polarized (from OCP) to the potential in between corrosion and repassivation potentials (−750 $mV_{SCE}$ in 0.01 M NaCl) and held at that potential for 30 min. Samples were then washed with distilled water and ethanol and dried in air at room temperature. Corrosion films thus produced were analyzed using a PHI VersaProbe II Scanning XPS Microprobe. A charge neutralizer was employed to minimize the photoemission charging effect and the diameters if the X-ray spot was of 250 μm. Quantitative data analysis was performed using MultiPak software.

Distribution of the $Na_2CrO_4$ in Al matrix after HEBM and consolidation was investigated using SEM. Back scatter electron images for Al containing $Na_2CrO_4$ were obtained. The inhibitor particles were not visible in Al containing up to 5 wt. % $Na_2CrO_4$, as size of the $Na_2CrO_4$ particles was too fine to be detected by SEM. Most of the added inhibitor was dispersed in the matrix and agglomerated particles appeared only in Al-20 wt. % $Na_2CrO_4$ because of high $Na_2CrO_4$ content, which was further confirmed by an EDXS elemental area map. EDXS analysis confirmed the presence of Na and Cr only in darker particles whereas the matrix contained mainly Al.

Cyclic potentiodynamic polarization (CPP) graphs for Al containing $Na_2CrO_4$ were obtained. The corrosion current density ($i_{corr}$). Corrosion potential ($E_{corr}$), pitting potential ($E_{pit}$), and repassivation potential ($E_{rp}$) were determined from cyclic potentiodynamic polarization. Increasing the inhibitor content from 0.5 to 5 wt. % caused ennoblement of the $E_{pit}$ (measure of pitting corrosion resistance) and $E_{rp}$ (measure of repassivation tendency) and a decrease in $i_{corr}$. Such an increase in corrosion resistance was attributed to release of the chromate ions as corrosion occurs and subsequent action of chromates in inhibiting the corrosion.

Higher inhibitor concentration (20 wt. %) resulted in the higher anodic current density, which can be attributed to the higher volume fraction of inhibitor and therefore significantly higher dissolution which formed a porous structure. Additionally, dissolution of the agglomerated particles formed larger pits and abetted the anodic current and $i_{corr}$. $E_{pit}$ and $E_{rp}$ could not be observed for Al-20 wt. % $Na_2CrO_4$; however, anodic current density in a reverse scan was lower than that in a forward scan, indicating excellent repassivation tendency.

Al containing various amounts of $Na_2CrO_4$ were immersed in 0.1 M NaCl for 15 days. A visual inspection indicated no significant corrosion in Al containing up to 5 wt. % $Na_2CrO_4$, whereas corrosion products were clearly visible on the Al containing 20 wt. % $Na_2CrO_4$. Surface of the corroded samples was analyzed using SEM after removing the corrosion products. The number of pits decreased upon increasing the chromate concentration from 0.5 to 5 wt. %. Al containing 20 wt. % $Na_2CrO_4$ showed significant corrosion and also the corrosion product could not be removed completely using $HNO_3$. CPP and immersion tests revealed that the corrosion resistance increased with increasing the $Na_2CrO_4$ content up to 5 wt. % and decreased for 20 wt. % $Na_2CrO_4$ content, where part of it appeared as agglomerated particles. These results indicate existence of a critical $Na_2CrO_4$ content for optimum corrosion resistance.

It is hypothesized herein that corrosion prevention by $Na_2CrO_4$ occurs by release of $Cr^{6+}$ which redeposits as $C^{3+}$ and therefore the presence of $C^{3+}$ in the passive film should support the hypothesis that the inhibitor was released and inhibited corrosion. Regional scans, performed on Al containing 5 and 20 wt. % $Na_2CrO_4$ showed the presence of Cr in the passive film. Cr content of the passive film on the Al containing 20 wt. % $Na_2CrO_4$ was higher. Cr was present as $Cr(OH)_3$ and $Cr_2O_3$. The passive film on Al-20 wt. % $Na_2CrO_4$ had higher $Cr_2O_3$ than $Cr(OH)_3$.

The CPP, immersion tests, and XPS confirmed that the Al containing $Na_2CrO_4$ exhibited excellent corrosion resistance, which was attributed to the uniform distribution of inhibitor particles in the metal, releasing inhibitor as the metal corrodes.

Various modifications and alterations that do not depart from the scope and spirit of this invention will become apparent to those skilled in the art. This invention is not to be duly limited to the illustrative embodiments set forth herein.

What is claimed is:

1. A method of making a metallic material, the method comprising steps of mechanically alloying base metal powder with corrosion inhibitor powder to thereby form an alloy powder having from 80 to 99.5 weight percent of the base metal and from 5 to 20 weight percent of the corrosion inhibitor, wherein the base metal has a size of from −50 mesh to +100 mesh, wherein the mechanically alloying step is high energy ball milling, where the alloy powder has a solute concentration of the corrosion inhibitor powder of larger than 50%, compacting the alloy powder to thereby form alloy compacts, wherein the compacting step is a cold compacting step occurring without an applied heat source, wherein the step of compacting occurs at a pressure at least above 1 GPa, wherein the compacting step is a step of pelletization such that the alloy compacts are alloy pellets, such that the alloy pellets are formed at the pressure at least above 1 GPa, wherein the base metal is selected from the group consisting of aluminum (Al), zinc (Zn), magnesium (Mg), and combinations thereof, and wherein the corrosion inhibitor is selected from the group consisting of sodium chromate ($Na_2CrO_4$), cerium nitrate ($Ce(NO_3)_3$), sodium vanadate ($Na_2VO_4$), and combinations thereof.

2. The method of claim 1, wherein the alloy pellets have a diameter in the range of from 0.5 mm to 10 cm.

3. The method of claim 1, wherein the alloy pellets have a hardness in the range of from 50 HV to 200 HV.

4. A method of making an alloy, the method comprising steps of combining base metal powder, corrosion inhibitor powder, and grinding balls in a ball mill rotation pot, rotating the ball mill rotation pot in a disk-planetary ball mill to thereby form an alloy powder having from 80 to 99.5 weight percent of the base metal powder and from 5 to 20 weight percent the corrosion inhibitor powder, wherein the base metal has a size of from −50 mesh to +100 mesh, wherein the disk-planetary ball mill is a high-energy ball mill, collecting a portion of the alloy powder as an alloy powder product, and filling a receptacle of a die with a second portion of the alloy powder, and compacting the second portion of the alloy powder within the die to form alloy compacts, wherein the step of compacting is a cold compacting step occurring without an applied heat source, wherein the step of compacting occurs at a pressure at least above 1 GPa, wherein the compacting step is a step of pelletization such that the alloy compact is an alloy pellet, such that the alloy pellets are formed at the pressure at least above 1 GPa, wherein the base metal powder is selected from the group consisting of aluminum (Al), zinc (Zn), magnesium (Mg), and combinations thereof, and wherein the corrosion inhibitor powder is selected from the group consisting of sodium chromate ($Na_2CrO_4$), cerium nitrate ($Ce(NO_3)_3$), sodium vanadate ($Na_2VO_4$), and combinations thereof.

5. The metallic material made by the method of claim 1.

6. The alloy made by the method of claim 4.

7. The method of claim 4, where the alloy powder includes a supersaturation of higher than 30% of the corrosion inhibitor powder.

* * * * *